US007114800B2

(12) United States Patent
Tsujimoto

(10) Patent No.: US 7,114,800 B2
(45) Date of Patent: Oct. 3, 2006

(54) INK SUPPLY SYSTEM AND INK CARTRIDGE

(75) Inventor: Akira Tsujimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 10/806,654

(22) Filed: Mar. 22, 2004

(65) Prior Publication Data

US 2004/0212664 A1 Oct. 28, 2004

(30) Foreign Application Priority Data

Apr. 25, 2003 (JP) ..... 2003-122008

(51) Int. Cl.
*B41J 2/175* (2006.01)

(52) U.S. Cl. ..... 347/86; 347/85

(58) Field of Classification Search ..... 347/36, 347/49, 85, 86, 87; 141/2, 18
See application file for complete search history.

(56) References Cited

U.S. PATENT DOCUMENTS 5,221,935 A * 6/1993 Uzita ..... 347/36
5,523,780 A 6/1996 Hirosawa
5,534,899 A * 7/1996 Uchikata et al. ..... 347/49
5,541,631 A 7/1996 Hashimoto
5,619,237 A * 4/1997 Inoue et al. ..... 347/86
6,102,533 A * 8/2000 Nozawa et al. ..... 347/86
6,454,400 B1 9/2002 Morita
6,705,715 B1 3/2004 Morita
6,929,356 B1 * 8/2005 Hirano et al. ..... 347/85
6,955,422 B1 * 10/2005 Miyazawa et al. ..... 347/86
2004/0104949 A1 6/2004 Morita

FOREIGN PATENT DOCUMENTS

JP 1-141750 A 6/1989
JP 9267487 * 10/1997

* cited by examiner

*Primary Examiner*—Anh T. N. Vo
(74) *Attorney, Agent, or Firm*—Canon U.S.A. Inc I. P. Div

(57) ABSTRACT

An ink supply system includes a recording apparatus and an ink cartridge. The recording apparatus has a recording head, configured to discharge ink, includes an ink storage chamber for storing ink therein and a plurality of ink receiving portions communicating with the ink storage chamber. The ink cartridge, detachably attached to the recording apparatus, contains ink and has a plurality of ink supply portions for supplying ink to the recording head. The recording head has a first positioning component between at least a pair of adjacent ink receiving portions, and the ink cartridge has a second positioning component provided between a corresponding pair of adjacent ink supply portions. The first and second positioning components are configured to engage each other so as to align the plurality of ink receiving portions and the plurality of ink supply portions relative to each other.

11 Claims, 7 Drawing Sheets

INK SUPPLY SYSTEM AND INK CARTRIDGE

BACKGROUND OF THE INVENTION

1. Field of the Invention

The present invention relates to an ink supply system, which is typified by an ink jet recording apparatus, and an ink cartridge.

2. Description of Related Art

Heretofore, the so-called pit-in (pit-stop) ink supply method has been known as one of methods for supplying ink to a liquid discharge head (ink jet head). In the pit-in ink supply method, there are provided a liquid storage container (sub-tank) for supplying a liquid to the liquid discharge head, and a liquid replenishing container (ink cartridge serving as a main tank) for replenishing the liquid storage container (sub-tank) with the liquid. A head cartridge, on which the sub-tank and the ink jet head are integrally mounted, is mounted on a carriage. Then, the carriage is moved to a predetermined position, in which a liquid supply member that is provided in a portion of the sub-tank is made to be connected to the liquid replenishing container (ink cartridge), so that the sub-tank is replenished with the liquid.

For the replenishment with ink using the pit-in ink supply method, it becomes necessary to have such an arrangement as to replenish the liquid storage container with a predetermined amount of ink neither too much nor too little. Accordingly, it becomes necessary to properly connect the liquid supply member that is provided in a portion of the liquid storage container to the liquid replenishing container (ink cartridge). Moreover, since the replenishment of the liquid storage container with ink is performed a number of times depending on the consumption of ink, the reliability and durability to be obtained when the liquid supply member that is provided in a portion of the liquid storage container is connected to the liquid replenishing container (ink cartridge) become important. Furthermore, in order to maximize the reliability obtained after the completion of such a connection, it is necessary to connect the liquid supply member that is provided in a portion of the liquid storage container to a predetermined supply portion of the ink cartridge with high precision.

Therefore, in Japanese Laid-Open Patent Application No. Hei 01-141750, there is disclosed, as one of commonly-used connection methods, an ink jet recording apparatus in which a part of the ink cartridge is provided with a protruding portion or portions for guiding the ink cartridge. The ink cartridge is locked and positioned relative to the ink jet recording apparatus by means of the protruding portion or portions.

In addition, in U.S. Pat. No. 5,541,631, there is disclosed an ink supply system in which a claw portion is provided on the surface of the ink supply port of an ink cartridge and a mounting portion for engagement with the claw portion is provided in an ink jet recording apparatus, and a projection of the claw portion serves to prevent the ink cartridge from being inserted into the main body of the ink jet recording apparatus in an erroneous manner and also serves as a latch for opening and closing of a cover of the ink jet recording apparatus when the ink cartridge is inserted.

Furthermore, in Japanese Laid-Open Patent Application No. 2000-127444, there is disclosed an ink supply system in which a positioning pin is provided on an ink cartridge and a positioning hole corresponding to the positioning pin is provided on the side of a holder for the ink cartridge, so that the precision of connection in the ink supply portion can be assured with the engagement between the positioning pin and the positioning hole.

In addition, for example, in U.S. Pat. No. 5,523,780, there is disclosed an ink supply system in which a positioning pin and an ink supply pipe are fixedly held at an interval and a mechanism for making a positioning-pin receiving portion and an ink-supply-pipe coupling portion integrally slidable relative to the positioning pin and the ink supply pipe is provided, so that the sliding portion is displaced in response to the coupling between the ink cartridge and the ink jet recording apparatus so as to perform positioning. There is also disclosed another ink supply system in which, conversely, the positioning-pin receiving portion and the ink-supply-pipe coupling portion are fixed and a mechanism for making the positioning pin and the ink supply pipe integrally slidable relative to the positioning-pin receiving portion and the ink-supply-pipe coupling portion is provided, so that the sliding portion is displaced in response to the coupling between the ink cartridge and the ink jet recording apparatus so as to perform positioning.

The ink cartridge positioning methods disclosed in the above-mentioned examples of prior art can be said to have been devised on the premise that an ink cartridge would be loaded into the ink jet recording apparatus only once or several times by an ordinary user. However, in cases where the replenishment of the sub-tank with ink is performed with the action of connecting the liquid supply member that is provided in a portion of the sub-tank to the liquid replenishing container (ink cartridge), as described in the foregoing, the sub-tank will be replenished with ink a plurality of times depending on the consumption of ink, and there is a probability that the replenishment of the sub-tank with ink will be performed several tens of times to several hundred times due to the use of a high-capacity ink cartridge. Therefore, there are required the high reliability and high durability in long-term use to be obtained when the liquid supply member that is provided in a portion of the liquid storage container is connected to the liquid replenishing container (ink cartridge).

In addition, on the other hand, in recent ink jet recording apparatuses, compatibility with color recording has been advancing, and such a type of ink jet recording apparatus that forms a color image by superimposing droplets by means of a plurality of color ink jet heads has come into wide use. In general, in color recording, there are three or four kinds of ink jet heads and ink cartridges corresponding to three primary colors, i.e., yellow (Y), magenta (M) and cyan (C), or four colors including black (B) in addition to the three primary colors.

In these days, ink jet recording apparatuses having ink jet heads for three or four colors mounted thereon to form a color image have been in practical use. Also, ink jet recording apparatuses capable of forming a high-definition image with photographic accuracy through the use of inks of six colors including light magenta (LM) and light cyan (LC) in addition to the above-mentioned four colors have been in practical use.

Accordingly, ink storage containers for inks of a plurality of colors come to be included in a single ink cartridge, and, therefore, it becomes necessary to perform ink replenishment (connection or coupling) individually for each color.

However, if a claw or pin such as that disclosed in the above-mentioned examples of prior art is provided in each of the connection portions for inks of a plurality of colors, an ink cartridge would increase in size.

Furthermore, in the embodiments disclosed in U.S. Pat. No. 5,523,780, since the sliding mechanism is provided on the side of the ink supply pipe or, conversely, on the side of the ink-supply-pipe coupling portion, an ink cartridge would tend to increase in size. Also, in cases where inks of a plurality of colors are used with the ink supply system having such a sliding mechanism, the sliding mechanism is required to be provided for each of coupled portions between the ink supply pipe and the ink-supply-pipe coupling portion for inks of a plurality of colors, so that such an ink supply system can not be said to be adapted to a small-sized printer. Further, in the case of a printer in which the ink replenishment (connection or coupling) is assumed to be performed a great number of times (several tens of times to several hundred times), there is a possibility that the sliding mechanism itself might deteriorate, so that it becomes necessary to improve durability of the sliding mechanism.

On the other hand, if, in order to prevent the ink cartridge from increasing in size, a single claw or pin is used to perform positioning of a plurality of coupled portions, it becomes difficult to absorb variations in the coupled portions, so that the precision of connection or coupling would diminish. Further, there is a probability that, as the precision of positioning lowers, surplus ink occurring at the time of connection or coupling will remain in the ink supply portion or the like of the ink cartridge. Such surplus ink will accumulate gradually according to the repetition of the above-mentioned connecting or coupling operation and then will spread over the ink supply portion, so that there is a possibility that inks of different colors will be mixed to cause a phenomenon of color mixture.

If the mixed inks of different colors are accidentally loaded into the liquid supply member that is provided in a portion of the sub-tank, the color of ink as discharged would vary, thereby lowering image quality and hindering the reliability of recording from being assured.

SUMMARY OF THE INVENTION

The present invention has been made in view of not only the above-mentioned necessity of the high reliability of positioning in the connecting or coupling portion and the high durability in long-term use but also the above-mentioned problems of the increase in size of an ink cartridge and the occurrence of color mixture arising from color recording. The present invention is directed to an ink supply system, in particular, employing the pit-in ink supply method, in which the arrangement of ink replenishment is inexpensive, the reduction in size thereof is possible, the performance thereof is stable, and the reliability thereof is high without ink leakage and color mixture.

In one aspect of the present invention, the ink supply system includes a recording apparatus having a recording head configured to discharge ink, the recording head including an ink storage chamber for storing ink therein and a plurality of ink receiving portions communicating with the inside of the ink storage chamber, and an ink cartridge capable of being detachably attached to the recording apparatus, the ink cartridge containing ink and having a plurality of ink supply portions for supplying ink to the recording head, ink being supplied from the ink cartridge to the ink storage chamber of the recording head with each of the plurality of ink receiving portions and the associated one of the plurality of ink supply portions connected to each other, wherein the recording head has at least one positioning protrusion between at least a pair of adjacent ink receiving portions of the plurality of ink receiving portions, and the ink cartridge has a positioning port provided between a pair of adjacent ink supply portions of the plurality of ink supply portions, the positioning protrusion being arranged to engage the positioning port to align the plurality of ink receiving portions and the plurality of ink supply portions relative to each other.

In the ink supply system configured as described above, the positioning protrusion is disposed between a pair of adjacent ink receiving portions of the plurality of ink receiving portions of the recording head, and the positioning port corresponding to the positioning protrusion is formed between a pair of adjacent ink supply portions of the plurality of ink supply portions of the ink cartridge. More specifically, the positioning protrusion is disposed in a pitch between a pair of adjacent ink receiving portions of the plurality of ink receiving portions, allowing the recording head to be compact in size. Further, the positioning port is formed in a pitch between a pair of adjacent ink supply portions of the plurality of ink supply portions, allowing the ink cartridge to be compact in size. Thus, the ink supply system according to the invention includes positioning components that do not increase the size of the ink jet recording apparatus. In addition, since the positioning port is formed between a pair of adjacent ink supply portions of the plurality of ink supply portions in the ink cartridge, even in the case of inks of a plurality of colors being supplied, color mixture can be prevented because surplus ink occurring during the supply of inks will come into the positioning port.

The above and further aspects, features and advantages of the present invention will become apparent to those skilled in the art upon reading of the following detailed description of preferred embodiments thereof when taken in conjunction with the accompanying drawings.

DETAILED DESCRIPTION OF THE PREFERRED EMBODIMENTS

Hereinafter, embodiments of the present invention will be described in detail with reference to the drawings.

(First Embodiment)

Figure 1:
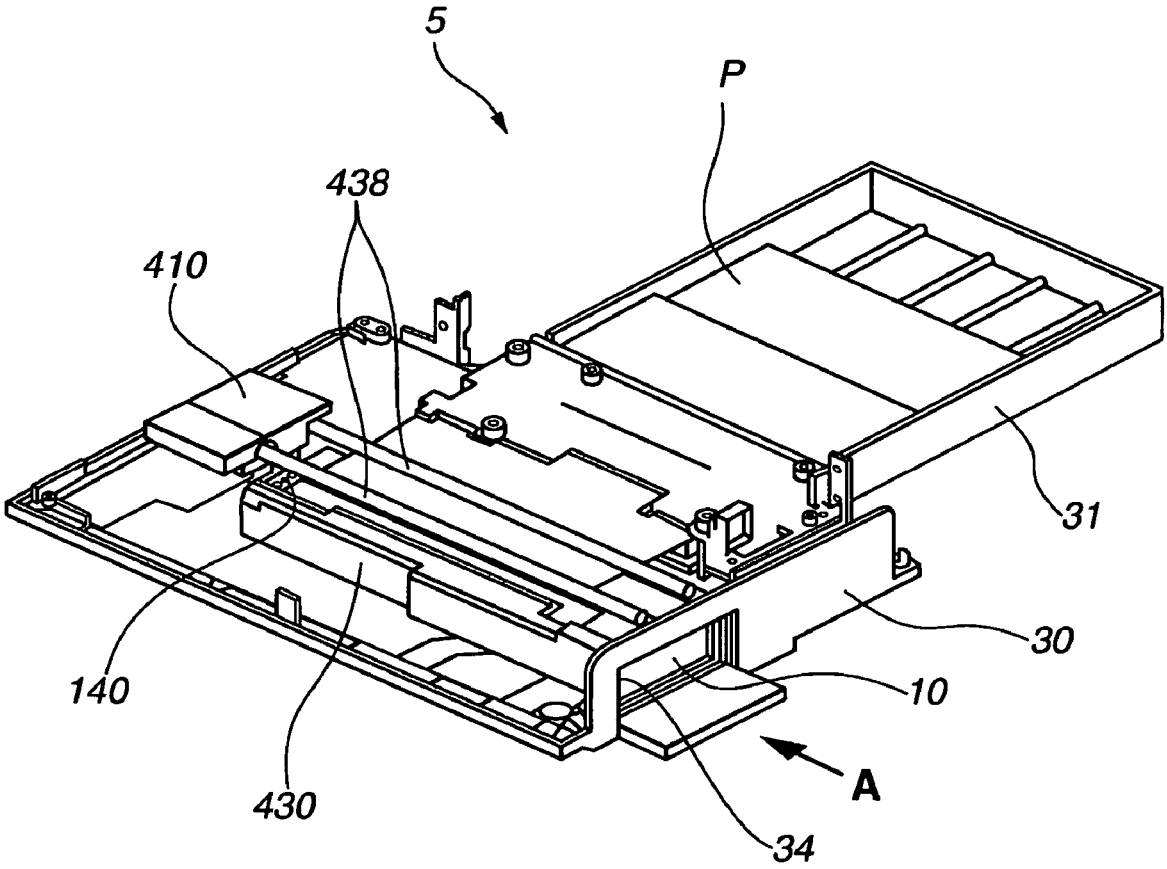
FIG. 1 is a perspective view showing an internal arrangement of an ink jet recording apparatus in an ink supply system according to a first embodiment of the invention.

FIG. 1 is a perspective view showing an internal arrangement of an Ink jet recording apparatus 30 in an ink supply system 5 according to a first embodiment of the invention.

To the back surface portion of the ink jet recording apparatus 30, a paper feed cassette 31 is detachably attached. Recording media P, each of which is to be supplied to the main body of the ink jet recording apparatus 30, are stored in piles within the paper feed cassette 31.

On the recording medium P, an intended image is formed with ink discharged by an ink jet head 410, which is configured to make a reciprocating motion while being supported by two guide rails 438 extending in the direction perpendicular to the direction of delivering of the recording medium P. Discharge of ink from the ink jet head 410 is performed by pushing out a liquid existing in a nozzle with heat or vibration energy generated by a heat generating element or a vibration element (both not shown) disposed in the vicinity of a discharge port 431 (see FIG. 6) of the nozzle.

Figure 7:
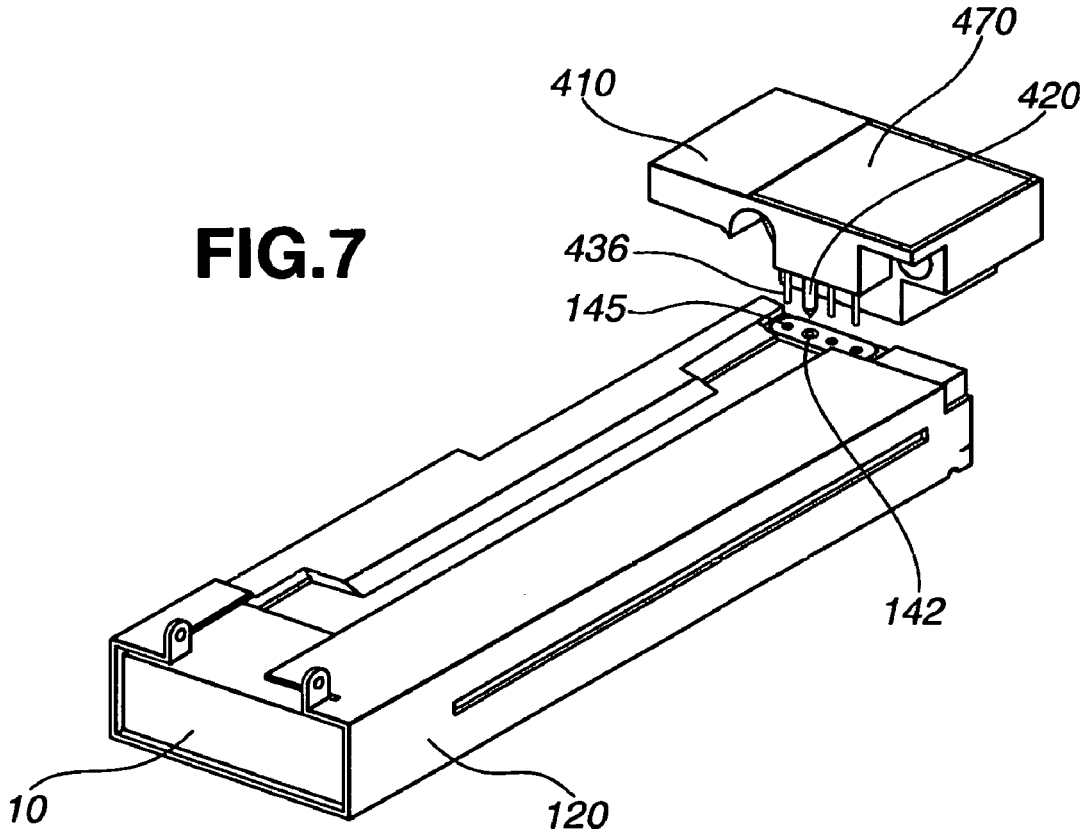
FIG. 7 is a perspective view showing the relationship between the ink jet head, which is situated in the home position thereof, and the ink cartridge.

Further, within the ink jet recording apparatus 30, an ink cartridge 10 that contains ink to be supplied to the ink jet head 410 is held in a detachable manner by an ink-cartridge guide frame 430. More specifically, the ink cartridge 10 is inserted into the ink jet recording apparatus 30 from an ink-cartridge replacement port 34 in the direction of arrow A. The ink cartridge 10 is then mounted in such a position on the side facing the discharge port 431 of the ink jet head 410 within the range of a traversing movement thereof that, when the ink jet head 410 is situated in a home position thereof as shown in FIG. 1, needle-like tubes 436 can be put in (inserted into) joint holes 145 of the ink cartridge 10 (as shown in FIG. 7).

Next, the ink cartridge 10 that is used with the ink jet recording apparatus 30 in the ink supply system 5 according to the first embodiment will be described in detail.

Figure 2:
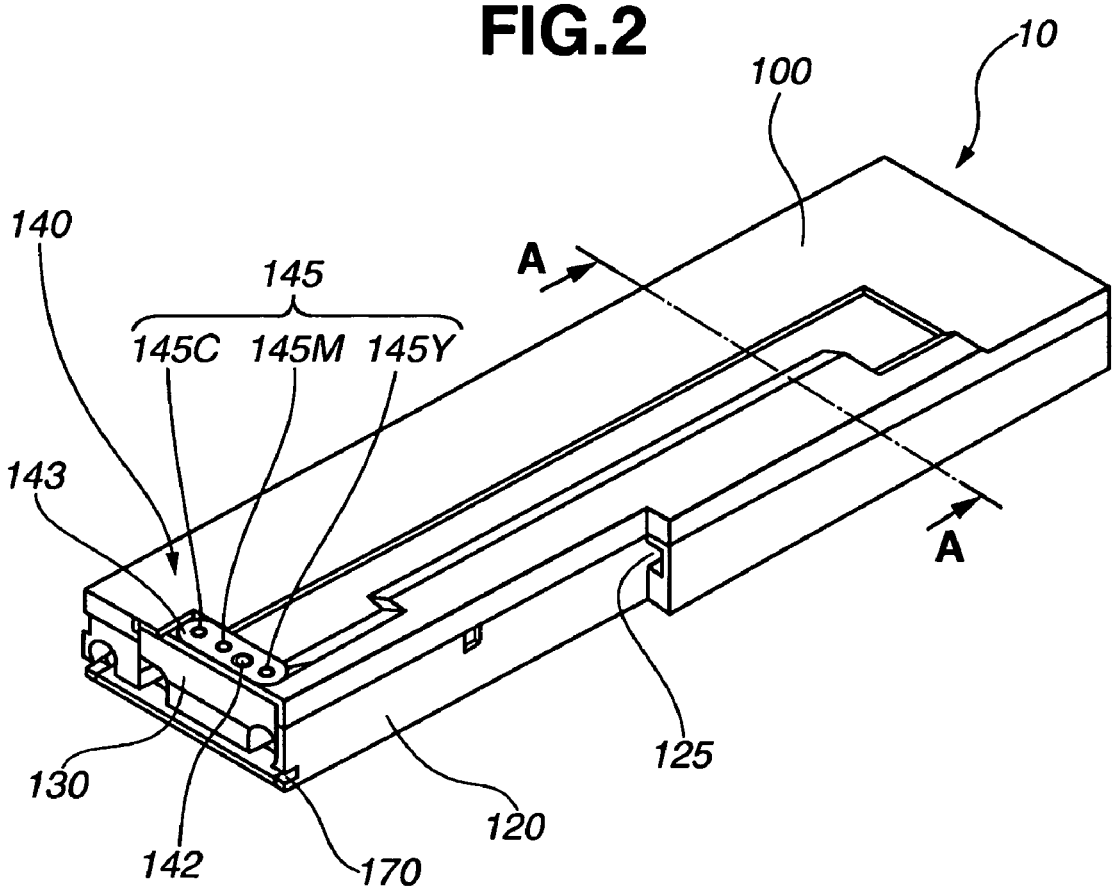
FIG. 2 is a perspective view of an ink cartridge according to the first embodiment.
Figure 3:
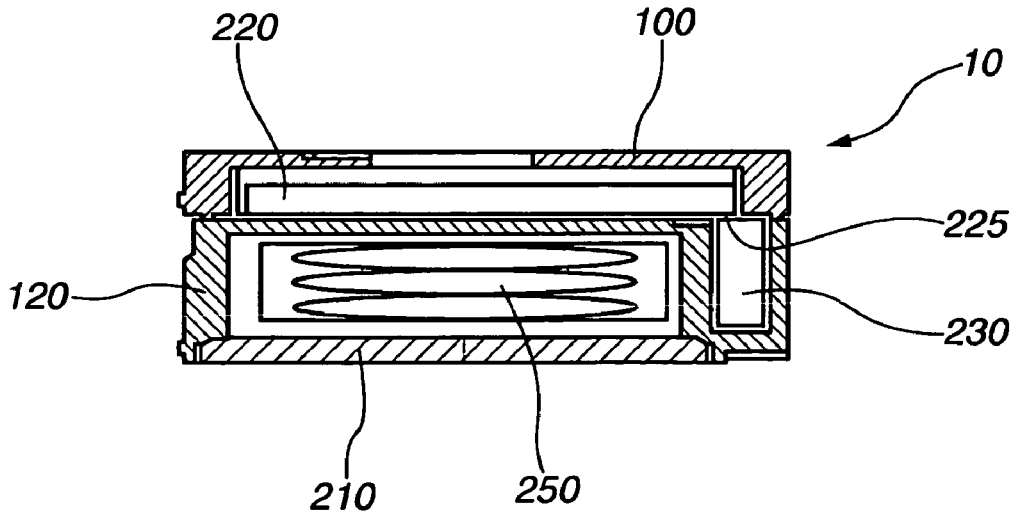
FIG. 3 is a sectional view of the ink cartridge as taken along line A—A in FIG. 2.
Figure 4:
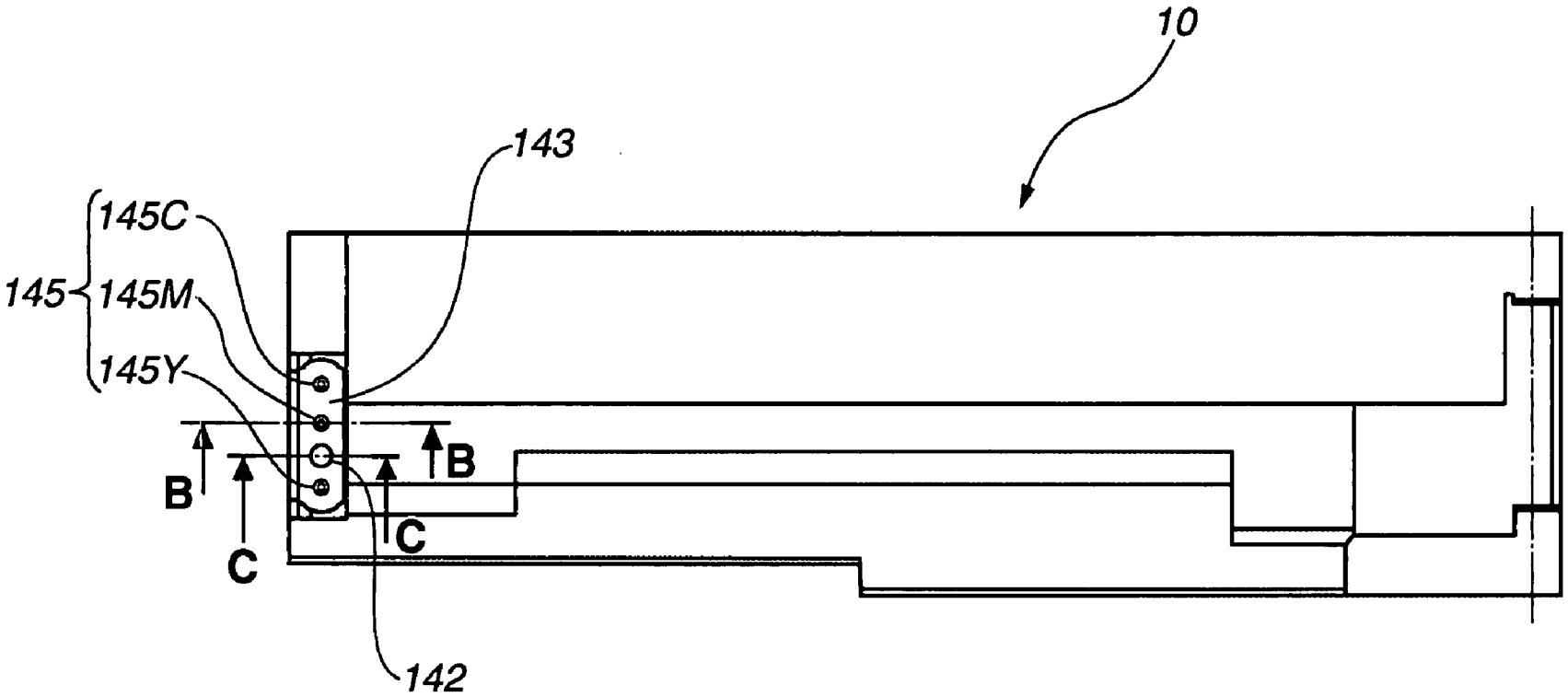
FIG. 4 is a top plan view of the ink cartridge shown in FIG. 2.
Figure 5A:
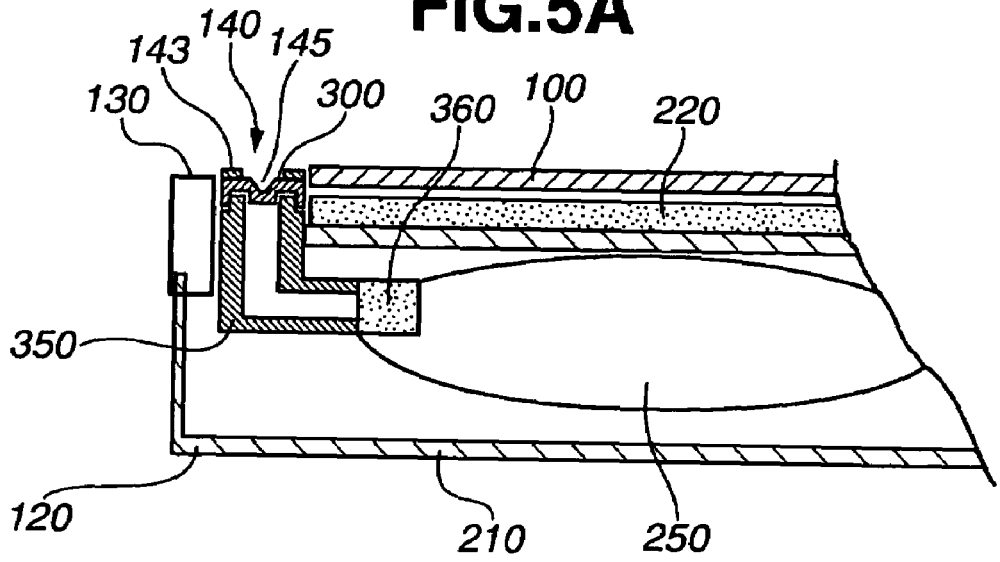
FIGS. 5A, 5B and 5C are a sectional view of the ink cartridge as taken along line B—B in FIG. 4, a sectional view of the ink cartridge as taken along line C—C in FIG. 4, and an enlarged view of the vicinity of a positioning member indicated by a portion C shown in FIG. 5B, respectively.
Figure 5B:
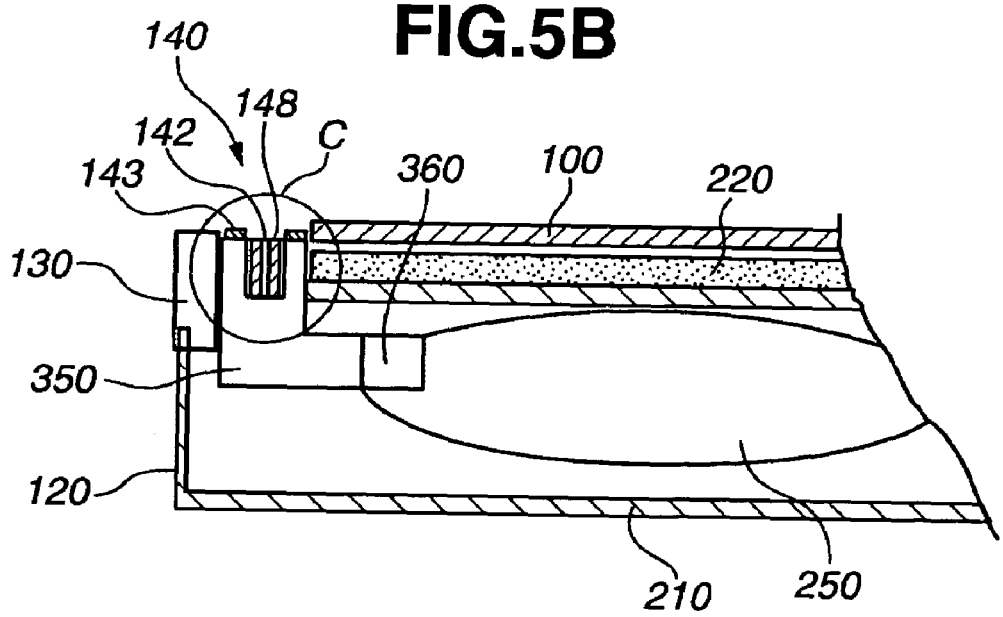
Figure 5C:
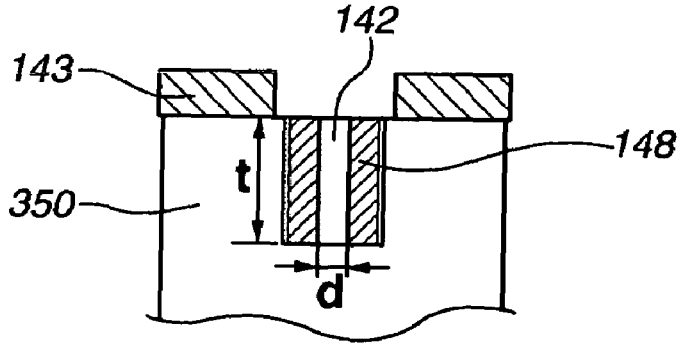

FIG. 2 is a perspective view showing the ink cartridge 10. FIG. 3 is a sectional view of the ink cartridge 10 as taken along line A—A in FIG. 2. FIG. 4 is a top plan view of the ink cartridge 10. FIGS. 5A, 5B and 5C are a sectional view of the ink cartridge 10 as taken along line B—B in FIG. 4, a sectional view of the ink cartridge 10 as taken along line C—C in FIG. 4, and an enlarged view of the vicinity of a positioning member 148 indicated by a portion C shown in FIG. 5B, respectively.

Referring to FIGS. 2 and 3, the ink cartridge 10 has a joint portion 140, which is used for supplying ink to the ink jet head 410. The ink cartridge 10 includes a container composed of, as principal exterior constituents, a casing portion 120 and a lid portion 100 disposed on an upper surface of the casing portion 120. The casing portion 120 includes an ink container 250 for separately storing three ink colors, i.e., yellow (Y), magenta (M) and cyan (C). The lid portion 100 includes a waste-ink absorbing member 220 for absorbing waste ink generated during such a recovery operation by suctioning ink from the discharge surface 432 of the ink jet head 410 (see FIG. 6). The waste ink is ejected from the main body of the ink jet recording apparatus 30 through a piping system, such as a pipe, and is delivered to the waste-ink absorbing member 220 through a waste-ink entrance portion 125.

Further, the ink cartridge 10 is provided with a groove portion 170 for engagement with a shaft (not shown) used for moving the ink cartridge 10 up and down with a cam or the like of the ink jet recording apparatus 30 to facilitate insertion of the needle-like tubes 436 into and out of the joint holes 145.

Referring to FIG. 4, the joint portion 140 is provided with a plurality of joint holes 145, such as a joint hole 145Y, a joint hole 145M and a joint hole 145C, and a positioning hole 142 formed between the joint hole 145Y and the joint hole 145M. The joint holes 145Y, 145M and 145C and the positioning hole 142 are arranged in a straight-line fashion.

The joint holes 145Y, 145M and 145C are adapted to receive needle-like tubes 436Y, 436M and 436C of the ink jet head 410 (shown in FIG. 6), which are arranged to supply inks of three colors Y, M and C stored in the ink container 250 to the ink jet head 410.

Also, the positioning hole 142, which is adapted to receive a complementary guide pin 420 (to be mentioned later), facilitates positioning and alignment of the joint holes 145Y, 145M and 145C and the needle-like tubes 436Y, 436M and 436C relative to each other.

It should be noted that, while, in the first embodiment, a single positioning hole 142 only is disposed between the joint hole 145Y and the joint hole 145M, the invention is not limited to such an arrangement. For example, a positioning hole may be provided between the joint hole 145M and the joint hole 145C, or two positioning holes in total may be formed between the joint hole 145Y and the joint hole 145M and between the joint hole 145M and the joint hole 145C, respectively.

Further, while, in the first embodiment, the joint holes 145Y, 145M and 145C and the positioning hole 142 are arranged in a straight-line fashion, the invention is not limited to such an arrangement. For example, a positioning hole may be arranged in parallel to the array of the joint holes.

Thus, in the first embodiment, any arrangement of joint holes and positioning holes may be employed as long as at least one positioning hole is disposed between at least a pair of adjacent joint holes and is not disposed outside a pitch of the joint holes. With such an arrangement employed, the guide pin is also made to be disposed between a pair of adjacent needle-like tubes, so that high-precision positioning can be performed without any increase in size of the ink cartridge and the ink jet head, i.e., without any increase in size of the ink jet recording apparatus.

In addition, even if ink adheres to the joint portion 140 of the ink cartridge 10 due to the joining action, since the positioning hole 142 is provided between a pair of adjacent joint holes 145, the surplus ink will drain into the positioning hole 142, so that color mixture can be prevented. It should be noted that, in the case of the first embodiment, in order to prevent yellow ink, which is apt to become conspicuous during color mixture, from mixing with the other ink colors, the positioning hole 142 is disposed between the joint hole 145Y and the joint hole 145M.

Referring to FIG. 5A, inside each of the joint holes 145, there is incorporated a sealing member 300 for preventing ink leakage or evaporation. The sealing member 300 is disposed on an upper open end of an ink communicating member 350. The sealing member 300 is press fixed onto the upper open end with a pressure plate 143. The material of the sealing member 300 may be selected from materials that are capable of resisting ink, that minimize ink evaporation from the sealing portion, and that are capable of lessening forces required for insertion and retraction of the needle-like tubes, such as chlorinated butyl rubber or silicon rubber and styrene-based rubber capable of elastomer molding.

The ink communicating member 350 has an elbow shape, with one end connected to the sealing member 300 and the other end connected to the ink container 250 through an ink-container connecting member 360. The ink communicating member 350 can be made from a plastic molding material of modified polyphenylether (PPE) or the like.

The pressure plate 143 can be made of SUS 303 stainless steel of 0.2 mm in board thickness, in which four apertures corresponding to the joint holes 145Y, 145M and 145C and the positioning hole 142, respectively, are formed.

Referring to FIGS. 5B and 5C, provided within the positioning hole 142 is a positioning member 148 having a hollow pipe shape that is embedded in the ink communicating member 350. The inner diameter of the positioning member 148 may be determined in consideration of the precision of positioning, the tolerances of deviation, etc., according to the relative engagement with a positioning portion 420*b* (see FIG. 6) of the guide pin 420 of the ink jet head 410. In the first embodiment, the material of the positioning member 148 is SUS 304 stainless steel, and the inner diameter "d" thereof is 1.9 mm and the depth "t" thereof is 4.3 mm.

Referring again to FIGS. 5A and 5B, an absorbing member 130, which is disposed in the vicinity of the joint portion 140, is configured to absorb extraneous matter adhering to a wiping member (not shown) when the wiping member wipes the discharge surface 432 of the ink jet head 410 during a recovery operation of the ink jet head 410. In the first embodiment, the absorbing member 130 can be made of a porous material in which a great number of fine pores are formed for absorption, such as polyethylene porous material of 1.2 mm in thickness. The extraneous matter adhering to the wiping member is absorbed by capillary force of the porous material itself. Furthermore, the material of the absorbing member 130 may be selected from materials that are capable of resisting ink and capable of remaining stable in strength and chemistry even after long-term contact with the wiping member, such as a polypropylene-based or polyurethane-based fiber.

Further, in the inside of the ink cartridge 10, the ink container 250 containing ink is housed while being surrounded by the casing portion 120 and a bottom plate 210, which serves as a bottom surface of the ink cartridge 10. In the first embodiment, the ink container 250 can be a bag-like container composed of a PET layer, an aluminum layer and a PP layer of several microns to several tens of microns in thickness and is deformable depending on the drawing-out of ink contained therein. When empty, the ink container 250 can be replaced by a new one together with the ink cartridge 10, thereby making it possible to continue recording. It should be noted that, in the first embodiment, taking into consideration the capacity of ink enabling recording on 50 sheets of paper, color inks of Y, M and C each are contained in the amount of 4 ml in the ink container 250. Further, for the purpose of simplification, only one ink container 250 is illustrated in FIGS. 5A and 5B.

A waste-ink absorbing member 220 is disposed between the casing portion 120 and the lid portion 100. The waste-ink absorbing member 220 is configured to absorb waste ink during recovery or maintenance operations by suctioning surplus ink from the discharge surface 432. The waste-ink absorbing member 220 can be made of a pulp nonwoven fabric and synthetic nonwoven fabric in a layered fashion and having a thickness of 3 mm or thereabout. The thickness of the waste-ink absorbing member 220 depends on the capacity required to absorb waste ink and the planar dimension of the waste-ink absorbing member 220.

Furthermore, as shown in FIG. 3, a waste-ink holding member 230 is provided inside of the ink cartridge 10. The waste-ink holding member 230 is configured to receive, at a waste-ink entrance portion 125, and hold waste ink delivered from the main body of the ink jet recording apparatus 30 through a piping system, such as a pipe. The waste-ink holding member 230 abuts the waste-ink absorbing member 220 at an abutting portion 225. Any waste ink resulting during the above-mentioned maintaining operation of the ink jet head 410 is absorbed by the waste-ink absorbing member 220 through the waste-ink holding member 230. The waste-ink holding member 230 may be formed integrally with the waste-ink absorbing member 220 by folding an end portion of the waste-ink absorbing member 220, or the like.

Next, the ink jet head for use with the ink jet recording apparatus in the ink supply system according to the first embodiment will be described.

Figure 6:
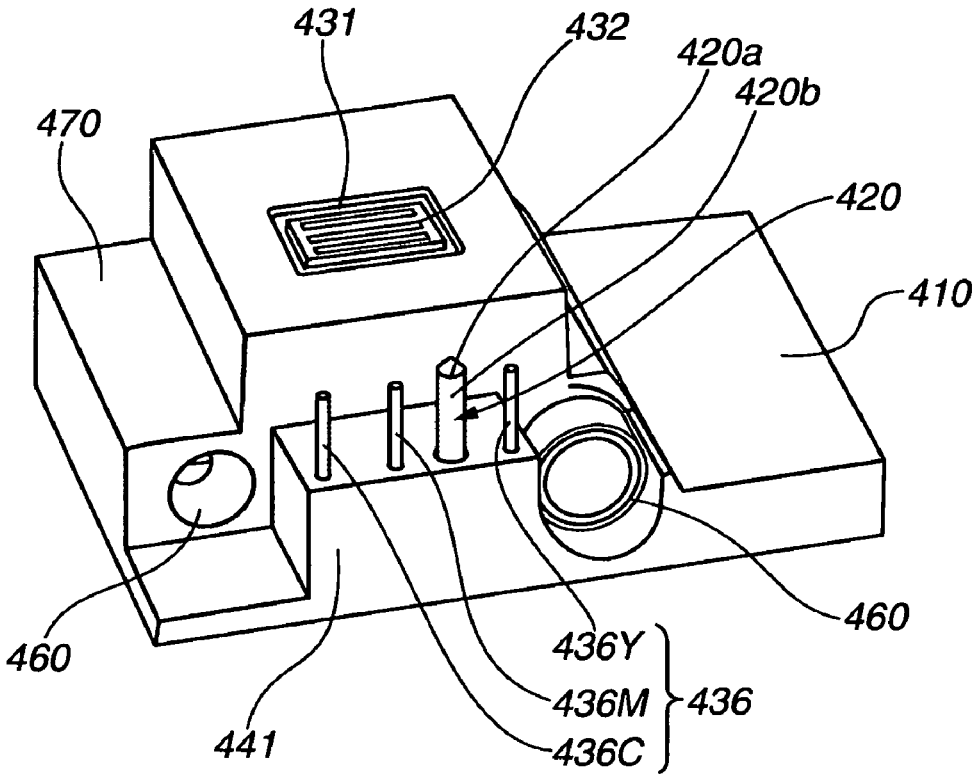
FIG. 6 is a perspective view of an ink jet head in the first embodiment as seen from the side of a discharge surface thereof.

FIG. 6 is a perspective view of the ink jet head 410 as seen from the side of the discharge surface 432.

On the discharge surface 432 of the ink jet head 410 is provided a discharge port 431 configured to discharge ink. As described above, liquid existing inside the nozzle is discharged with heat or vibration energy generated by a heat generating element or a vibration element (both not shown) disposed in the vicinity of the discharge port 431 of the nozzle.

On a head-side joint portion 441 of the ink jet head 410, there are provided the needle-like tubes 436, including needle-like tubes 436Y, 436M and 436C corresponding to the joint holes 145Y, 145M and 145C provided in the joint portion 140 of the ink cartridge 10. The needle-like tubes 436Y, 436M and 436C, serving as ink receiving portions, communicate with an ink storage chamber 470 inside the ink jet head 410, which separately stores inks of three colors. Then, during the supply of ink, the needle-like tubes 436Y, 436M and 436C are inserted into the joint holes 145Y, 145M and 145C, respectively, so as to receive the supply of ink from the ink container 250 of the ink cartridge 10.

Further, between the needle-like tube 436Y and the needle-like tube 436M, there is provided the guide pin 420 corresponding to the positioning hole 142. The guide pin 420 includes a tip portion 420*a* having a conical shape and a positioning portion 420*b*. The guide pin 420 is adapted for insertion into the positioning hole 142 so as to position and align the needle-like tubes 436Y, 436M and 436C and the joint holes 145Y, 145M and 145C relative to each other. The length of the guide pin 420 is longer than the lengths of the needle-like tubes 436Y, 436M and 436C. Therefore, the guide pin 420 is inserted into the positioning hole 142 before the needle-like tubes 436 are inserted into the joint holes 145.

Further, in the ink jet head 410, there are provided two bearings 460 on both sides of the discharge port 431 and the head-side joint portion 441. The guide rails 438 (shown in FIG. 1) support the ink jet head 410 via the two bearings 460.

Next, an ink supply operation in the ink supply system 5 according to the first embodiment will be described.

In the ink supply system 5 using the ink cartridge 10 in the first embodiment, the so-called pit-in (pit-stop) ink supply method is employed, in which ink is intermittently supplied to the ink jet head 410.

More specifically, when ink stored in the ink storage chamber 470 of the ink jet head 410 has been depleted to a predetermined level, the ink jet head 410 returns to its home position. In the home position of the ink jet head 410, the needle-like tubes 436 are inserted into the joint holes 145, and, then, a predetermined amount of ink is supplied to the inside of the ink storage chamber 470 of the ink jet head 410 from the ink container 250 with the aid of a negative pressure generated by a pump (not shown) connected to the ink jet head 410.

When the ink supply operation is completed, the needle-like tubes 436 provided on the ink jet head 410 are released or retracted from engagement with the joint holes 145. Then, the ink jet head 410 is ready for printing operations. Recording is performed with the ink jet head 410 being transported in a scanning fashion over the recording medium P.

After completion of a predetermined volume of recording, the needle-like tubes 436 of the ink jet head 410 are again inserted into the joint holes 145, and, then, a predetermined amount of ink is supplied to the ink jet head 410 from the ink container 250 with the aid of a negative pressure generated by the pump connected to the ink jet head 410.

Thus, in the ink supply system 5 according to the first embodiment, the action of inserting the needle-like tubes 436 into the Joint holes 145 of the joint portion 140 and the action of releasing such an insertion are repeated alternately.

Next, the positioning and alignment of the needle-like tubes 436 of the ink jet head 410 relative to the joint holes 145 of the ink cartridge 10 and the insertion of the needle-like tubes 436 into the joint holes 145 will be described.

Figure 8A:
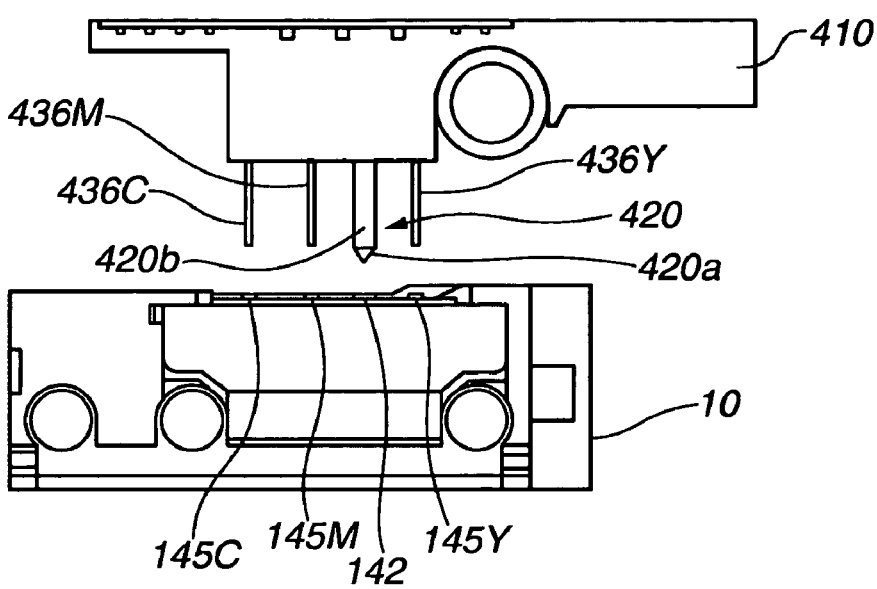
FIGS. 8A, 8B and 8C are diagrams showing stages of needle-like tubes and a guide pin of the ink jet head being inserted into joint holes and a positioning hole of the ink cartridge, as seen from the side of a joint portion.
Figure 8B:
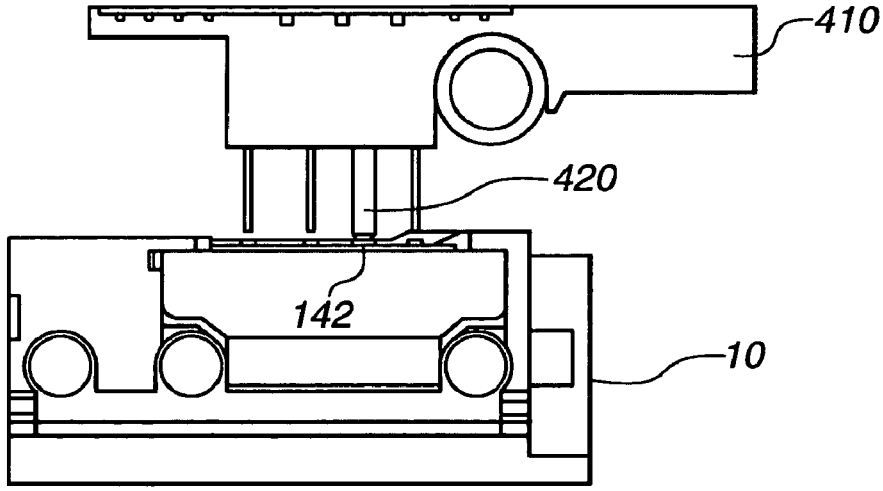
Figure 8C:
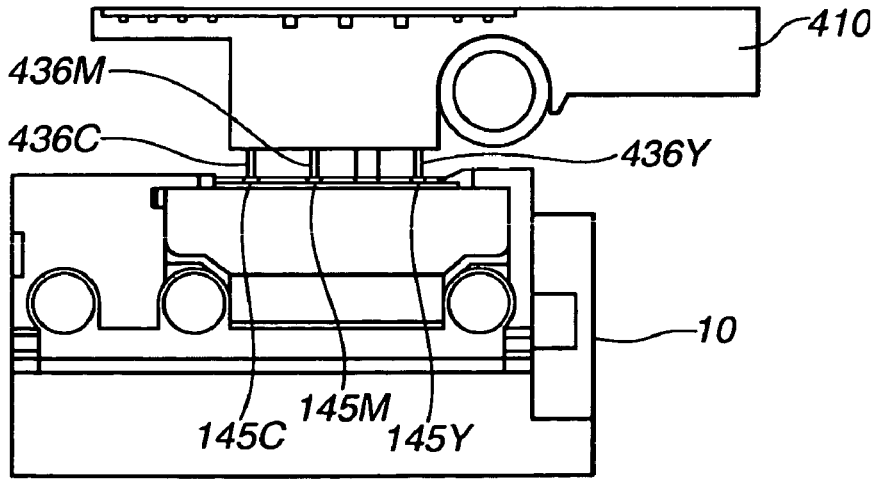

FIG. 7 is a perspective view showing the positional relationship between the ink jet head 410 situated in the home position and the ink cartridge 10. FIGS. 8A, 8B and 8C are diagrams showing stages of the needle-like tubes 436 and the guide pin 420 of the ink jet head 410 being inserted into the joint holes 145 and the positioning hole 142 of the ink cartridge 10, as seen from the side of the joint portion 140.

When the ink jet head 410 is situated in the home position as shown in FIGS. 7 and 8A, the needle-like tubes 436 and the guide pin 420 of the ink jet head 410 are positioned just above the joint holes 145 and the positioning hole 142 of the ink cartridge 10, respectively.

The ink cartridge 10 begins moving upward from the position shown in FIG. 8A. At the position shown in FIG. 8B, the tip portion 420*a* of the guide pin 420, which is longer than each of the needle-like tubes 436Y, 436M and 436C, begins being inserted into the positioning hole 142. At this position, the needle-like tubes 436Y, 436M and 436C have not yet been inserted into the joint holes 145Y, 145M and 145C.

As the ink cartridge 10 moves further upward from the position shown in FIG. 8B to the position shown in FIG. 8C, the positioning portion 420*b* of the guide pin 420, which has been guided into the positioning hole 142 by the cone-shaped tip portion 420*a*, is caused to be inserted into the positioning hole 142. As the guide pin 420 is being inserted into the positioning hole 142, the needle-like tubes 436Y, 436M and 436C are positioned and aligned relative to the joint holes 145Y, 145M and 145C.

As the ink cartridge 10 continues moving further upward, the needle-like tubes 436Y, 436M and 436C are caused to be inserted into the joint holes 145Y, 145M and 145C, respectively, as shown in FIG. 8C. After the needle-like tubes 436 have been inserted into the joint holes 145 to a predetermined extent, the ink supply operation begins.

As has been described above, the ink supply system 5 according to the first embodiment is arranged such that, after the completion of positioning by the guide pin 420, which is longer than each of the needle-like tubes 436, the needle-like tubes 436 are inserted into the joint holes 145. Therefore, the ink jet head 410 and the ink cartridge 10 are coupled to each other with high precision.

Further, the design consideration of the positioning hole 142 formed in a pitch between the joint hole 145Y and the joint hole 145M lends itself to the ink cartridge 10 being compact/small in size. Further, the design consideration of the guide pin 420 correspondingly disposed in a pitch between the needle-like tube 436Y and the needle-like tube 436M lends itself to the ink jet head 410 also being compact/small in size. Therefore, these design considerations lend themselves to the ink jet recording apparatus 30 being compact/small in size.

In addition, since the positioning hole 142 is formed in a pitch between the joint hole 145Y and the joint hole 145M, even if ink adheres to the joint portion 140, the surplus ink will come into the positioning hole 142, so that ink of yellow, which is apt to become conspicuous during color mixture, can be prevented from mixing with ink of different color.

(Second Embodiment)

Figure 9:
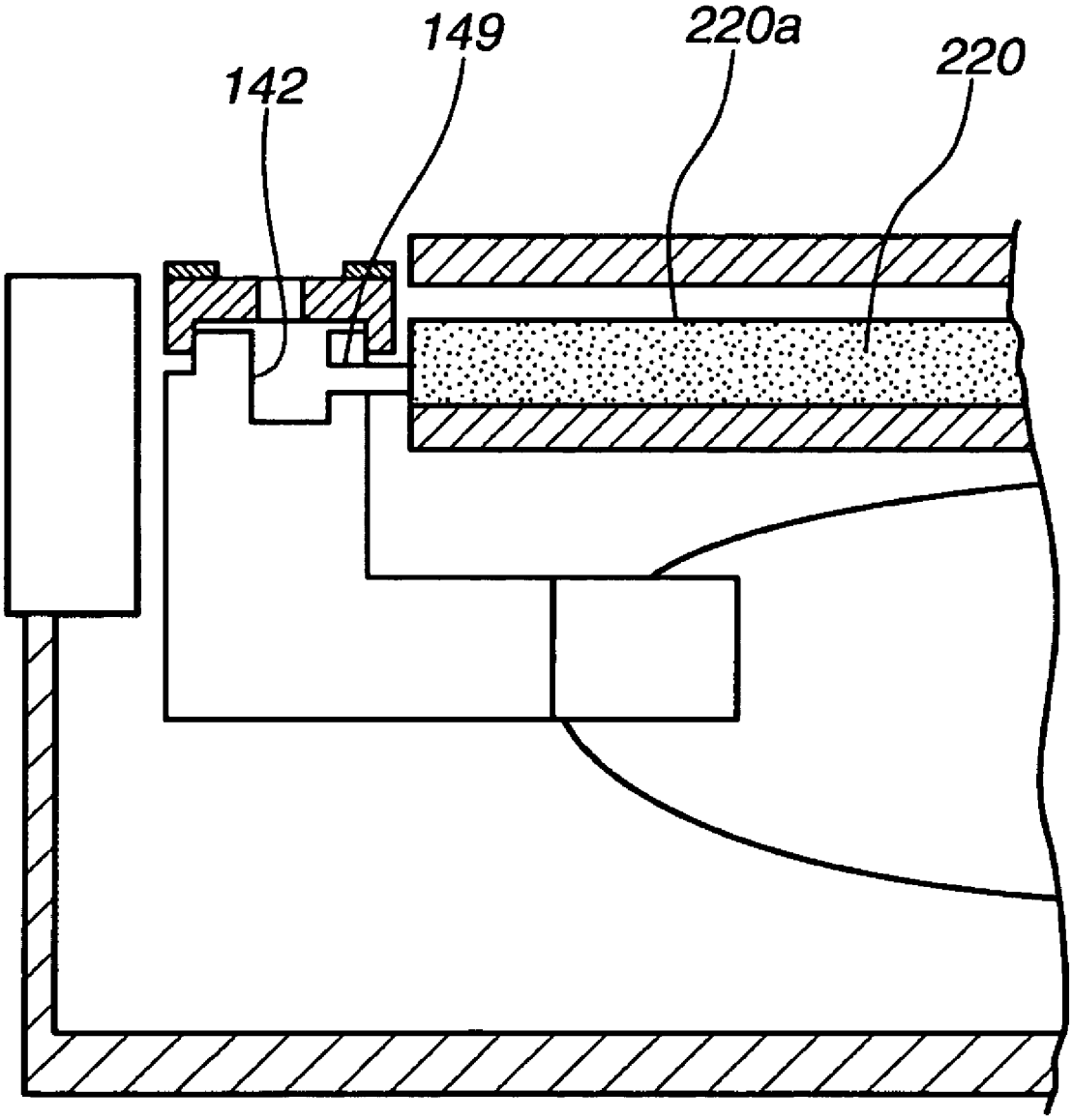
FIG. 9 is a sectional view showing the vicinity of a positioning hole of an ink cartridge according to a second embodiment of the invention.

FIG. 9 is a sectional view showing the vicinity of a positioning hole 142 of an ink cartridge according to a second embodiment of the invention.

The structural arrangement in the second embodiment is the same as that in the first embodiment except that there is provided a communicating tube 149. The positioning hole 142 communicates with a waste-ink-absorbing-member housing portion 220*a* via the communicating tube 149. The portion 220*a* houses the waste-ink absorbing member 220 therein.

In the second embodiment, since the positioning hole 142 is in communication with the waste-ink-absorbing-member housing portion 220*a* by the communicating tube 149, surplus ink that has adhered to the joint portion 140 and then come into the positioning hole 142 can be delivered to the waste-ink absorbing member 220 through the communicating tube 149. Accordingly, even if a large amount of surplus ink adheres to the joint portion 140 due to long-term and repetitive joining operations between the ink jet head and the ink cartridge, it is possible to deliver such surplus ink to the waste-ink absorbing member 220 through the communicating tube 149. Therefore, color mixture or the like is minimized.

As has been described above, according to the invention, the recording head has at least one positioning protrusion between at least a pair of adjacent ink receiving portions of a plurality of ink receiving portions, and the ink cartridge has a positioning hole formed therein corresponding to the positioning protrusion between a pair of adjacent ink supply portions of a plurality of ink supply portions. Accordingly, this design consideration lends itself to the ink jet recording apparatus being compact in size. It should be noted that alternatively, the recording head can be provided with the positioning hole and the ink cartridge can be provided with the positioning protrusion.

Furthermore, according to the invention, surplus ink will come into the positioning hole formed between a pair of adjacent ink supply portions of the plurality of ink supply portions in the ink cartridge, so that color mixture, which might occur during the supply of inks of different colors, can be prevented.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention.

What is claimed is:

1. An ink supply system comprising:

a recording apparatus having a recording head configured to discharge ink, said recording head including an ink storage chamber storing ink therein and a plurality of ink receiving portions in communication with said ink storage chamber;

an ink cartridge detachably attached to said recording apparatus, said ink cartridge including an ink container containing ink therein and a plurality of ink supplying portions complementary to said plurality of ink receiving portions, said plurality of ink supplying portions being in communication with said ink container;

said plurality of ink supplying portions being adapted to receive said complementary plurality of ink receiving portions to facilitate supplying ink from said ink container to said ink storage chamber;

said recording head including a first positioning component adjacent to said plurality of ink receiving portions, and said ink cartridge including a second positioning component adjacent to said plurality of ink supplying portions;

wherein said first and second positioning components are configured to engage each other so as to align said plurality of ink receiving portions relative to said plurality of ink supplying portions, wherein the first positioning component is disposed adjacent to a pair of the plurality of ink receiving portions, wherein the second positioning component is disposed adjacent to a complementary pair of the plurality of ink supplying portions, wherein the first positioning component is disposed between the pair of the plurality of ink receiving portions, and wherein the second positioning component is disposed between the complementary pair of the plurality of ink supplying portions.

2. An ink supply system according to claim 1, wherein the first positioning component includes a protrusion and the second positioning component includes a hole adapted to receive said protrusion therein.

3. An ink supply system according to claim 2, wherein the protrusion and the plurality of ink receiving portions have lengths, and wherein said length of said protrusion is longer than said lengths of said plurality of ink receiving portions.

4. An ink supply system according to claim 1, wherein the second positioning component includes a protrusion and the first positioning component includes a hole adapted to receive said protrusion therein.

5. An ink supply system according to claim 4, wherein the protrusion and the plurality of ink receiving portions have lengths, and wherein said length of said protrusion is longer than said lengths of said plurality of ink receiving portions.

6. An ink supply system according to claim 1, wherein the recording apparatus is an ink jet recording apparatus.

7. An ink supply system according to claim 1, wherein the ink cartridge includes a waste ink container in communication with the second positioning component.

8. An ink cartridge for supplying ink to a recording apparatus having a recording head configured to discharge ink, said recording head including an ink storage chamber storing ink therein, a plurality of ink receiving portions communicating with the ink storage chamber and a protrusion defined between a pair of adjacent ink receiving portions, said ink cartridge comprising:

an ink containing portion containing ink therein;

a plurality of ink supply portions corresponding to the plurality of ink receiving portions, the plurality of ink supply portions in communication with the ink containing portion; and an engagement portion provided between a pair of adjacent ink supply portions corresponding to the pair of adjacent ink receiving portions, wherein the engagement portion is capable of engaging said protrusion so as to align the plurality of ink supply portions with the corresponding plurality of ink receiving portions.

9. An ink cartridge according to claim 8, wherein said plurality of ink supply portions include at least three ink supply portions for yellow ink, magenta ink and cyan ink, respectively, and said engagement portion is disposed between the ink supply portion for yellow ink and the ink supply portion for magenta ink.

10. An ink cartridge according to claim 8, wherein said engagement portion is a port configured to receive said protrusion so as to align the plurality of ink receiving portions and the corresponding plurality of ink supply portions relative to each other.

11. An ink cartridge according to claim 8, further comprising a waste ink container in communication with the port.

* * * * *